US007350261B2

(12) United States Patent
Lee et al.

(10) Patent No.: US 7,350,261 B2
(45) Date of Patent: Apr. 1, 2008

(54) ACCESSORY SUPPORT FOR AN UPRIGHT VACUUM CLEANER AND ACCESSORY UNIT

(75) Inventors: Byung-jo Lee, Gwangju (KR); Yun-hee Park, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 605 days.

(21) Appl. No.: 10/946,606

(22) Filed: Sep. 21, 2004

(65) Prior Publication Data

US 2005/0268426 A1 Dec. 8, 2005

(30) Foreign Application Priority Data

Jun. 4, 2004 (KR) ..... 10-2004-0040999

(51) Int. Cl.
*A47L 9/00* (2006.01)

(52) U.S. Cl. ..... 15/323; 15/410

(58) Field of Classification Search ..... None
See application file for complete search history.

(56) References Cited

U.S. PATENT DOCUMENTS 2,854,686 A * 10/1958 Hansen ..... 15/327.5
5,732,438 A 3/1998 Tuvin et al.

FOREIGN PATENT DOCUMENTS

| | | |
|---|---|---|
| EP | 0928595 | 7/1999 |
| KR | 2001 0106673 A | 12/2001 |
| WO | WO00/47101 | 8/2000 |

* cited by examiner

*Primary Examiner*—David A Redding
(74) *Attorney, Agent, or Firm*—Ladas & Parry LLP

(57) ABSTRACT

An accessory support for an upright type vacuum cleaner, the upright type vacuum cleaner comprising a cleaner body, a suction brush formed adjacent a lower part of the cleaner body, and a handle engaged with the cleaner body, the accessory support comprising: a hanger attached to a connecting part between the handle and the cleaner body; and a support bracket detachably attached to the hanger, and having a mounting part on which the accessory is removably mounted.

15 Claims, 7 Drawing Sheets

ACCESSORY SUPPORT FOR AN UPRIGHT VACUUM CLEANER AND ACCESSORY UNIT

CROSS-REFERENCE TO RELATED APPLICATIONS

This application claims the benefit of Korean Patent Application No. 2004-40999 filed Jun. 4, 2004, in the Korean Intellectual Property Office, the disclosure of which is incorporated herein by reference.

BACKGROUND OF THE INVENTION

1. Field of the Invention

The present invention relates generally to an upright type vacuum cleaner, and more particularly, to an accessory support for storing the accessories of the vacuum cleaner.

2. Description of the Background Art

Generally, an upright type vacuum cleaner comprises a cleaner body to which a handle is attached on an upper portion thereof, and a suction brush movably, and preferably rotatably, engaged to a lower part of the cleaner body.

A motor driving chamber and a dust-collecting chamber are formed inside the cleaner body. A driving motor is installed in the motor driving chamber to generate a suction force for operation of the vacuum cleaner. The motor driving chamber is connected with the dust-collecting chamber. A filtering means is attached inside the dust-collecting chamber to filter out contaminants from the drawn in air. The filtering means may include a cyclone dust collector or a dust bag. The dust-collecting chamber is connected to the suction brush through a connecting hose. Accordingly, the suction force generated from the driving motor is transmitted to the suction brush via the dust-collecting chamber and the connecting hose. One end of the connecting hose is removably attached to the suction brush. Therefore, the suction hose can be detached from the suction brush for the cleaning of crevice areas, such as corners of the room, or places located at a height higher than the floor.

Separate accessories, such as a mini-turbine brush for the cleaning of special materials, for example, a carpet or blanket, can be attached to the connecting hose. A manufacturer of the upright type vacuum cleaner usually offers accessories, such as a turbine brush, or crevice cleaning tools, for use in specific applications, which accessories can be connected to the connecting hose.

A problem arises in that the accessories used for certain situations usually are separately stowed in an unspecified or hard to access place. Accordingly, the user experiences inconvenience when having to search for the specific accessory for an application and when needing to connect the accessory to the connecting hose.

SUMMARY OF THE INVENTION

The present invention has been developed in order to solve the above drawbacks and other problems associated with upright type vacuum cleaners utilizing the conventional arrangement. An aspect of the present invention is to provide an accessory support for an upright type vacuum cleaner which can support the accessories of the cleaner in a stowed position, and an accessory unit thereof.

In an upright type vacuum cleaner comprising a cleaner body, a suction brush disposed on a lower part of the cleaner body, a handle connected to the cleaner body and a connecting part between the handle and the cleaner body, an accessory support for use with an upright type vacuum cleaner to support an accessory according to one aspect of the present invention comprises a hanger attached to the connecting part between the handle and the cleaner body, and a support bracket detachably attached to the hanger, and having a mounting part on which the accessory may be removably mounted.

The hanger comprises a band body having a hollow opening for receiving the connecting part therein, the band body taking on the configuration substantially of an incomplete circle terminating at two terminating ends; mating parts formed on both terminating ends of the band body for complementary engagement to each other; and first fastening parts provided adjacent both terminating ends of the band body, for engagement with the mating parts and then with the support bracket.

The first fastening parts comprise fastening ribs formed at both terminating ends of the band body.

The connecting part has a hole formed therein, and the band body has a protrusion for insertion into the hole of the connecting part, formed on an inner surface for contacting the connecting part.

Each mating part preferably comprises: a positioning hole formed adjacent a first terminating end of the band body; a positioning protrusion for insertion in the positioning hole, provided adjacent a second terminating end of the band body; and fastening holes provided to the first and the second terminating ends of the band body, the fastening holes being aligned with each other when the positioning protrusion is engaged in the positioning hole.

The positioning protrusion and the positioning hole are engaged with each other such that when the band body wraps around the connecting part, the connecting part extends in a direction substantially transverse to the plane defined by the band body.

The band body comprises a resilient part capable of temporary deformation by an external force and recoverable to an original state when released from the external force, thereby enabling the mating parts to removably engage with each other.

The support bracket preferably comprises: a body including the mounting part; and a second fastening part provided to the back of the surface on which the mount parting is provided, being detachably attached to the hanger.

The mounting part preferably comprises: a main support provided at a lower portion of the body to encompass a first end of the accessory; and a resilient support provided at an upper portion of the body, facing in opposing relation to the main support, so as to resiliently support a second end of the accessory.

The main support and the resilient support each comprises a position fixing part to restrict movement of the accessory.

The resilient support comprises a handle tab for assisting in resilient deformation of the resilient support.

The second fastening part comprises a slit formed in the back of the surface on which the mounting part of the body is provided, along which the hanger may be slidably engaged.

The accessory may comprise a turbine brush, which is connected to a first end of a connecting hose, as desired the connecting hose being connected at the first end to the suction brush and connected at a second end to the cleaner body.

According to another aspect of the present invention, an accessory unit for use in an upright type vacuum cleaner comprises a turbine brush selectively connected to a first end of a connecting hose, the connecting hose for connecting a suction brush formed at a lower part of the cleaner body to the cleaner body; a hanger detachably attached to the cleaner body; and a support bracket detachably attached to the hanger, and having a mounting part on which the turbine brush may be removably mounted.

The turbine brush preferably comprises a brush body having a suction port therein and a connecting tube to connect the brush body and the connecting hose, and the support bracket may comprise a main support encompassing and supporting the brush body, and a resilient support for resiliently retaining the brush body and locking in an end of the connecting tube.

The main support and the brush body respectively comprise a position fixing hole and a position fixing protrusion for complimentary engagement with each other.

The hanger and the support bracket each comprise a fastening rib and a corresponding slit for providing a mechanism to slidably fasten the hanger to the support bracket along the direction determined by the weight of the turbine brush.

BRIEF DESCRIPTION OF THE DRAWINGS

The above aspects and features of the present invention will become more apparent by description below of certain embodiments of the present invention with reference to the accompanying drawings, in which.

DETAILED DESCRIPTION OF THE EXEMPLARY EMBODIMENTS

Figure 1:
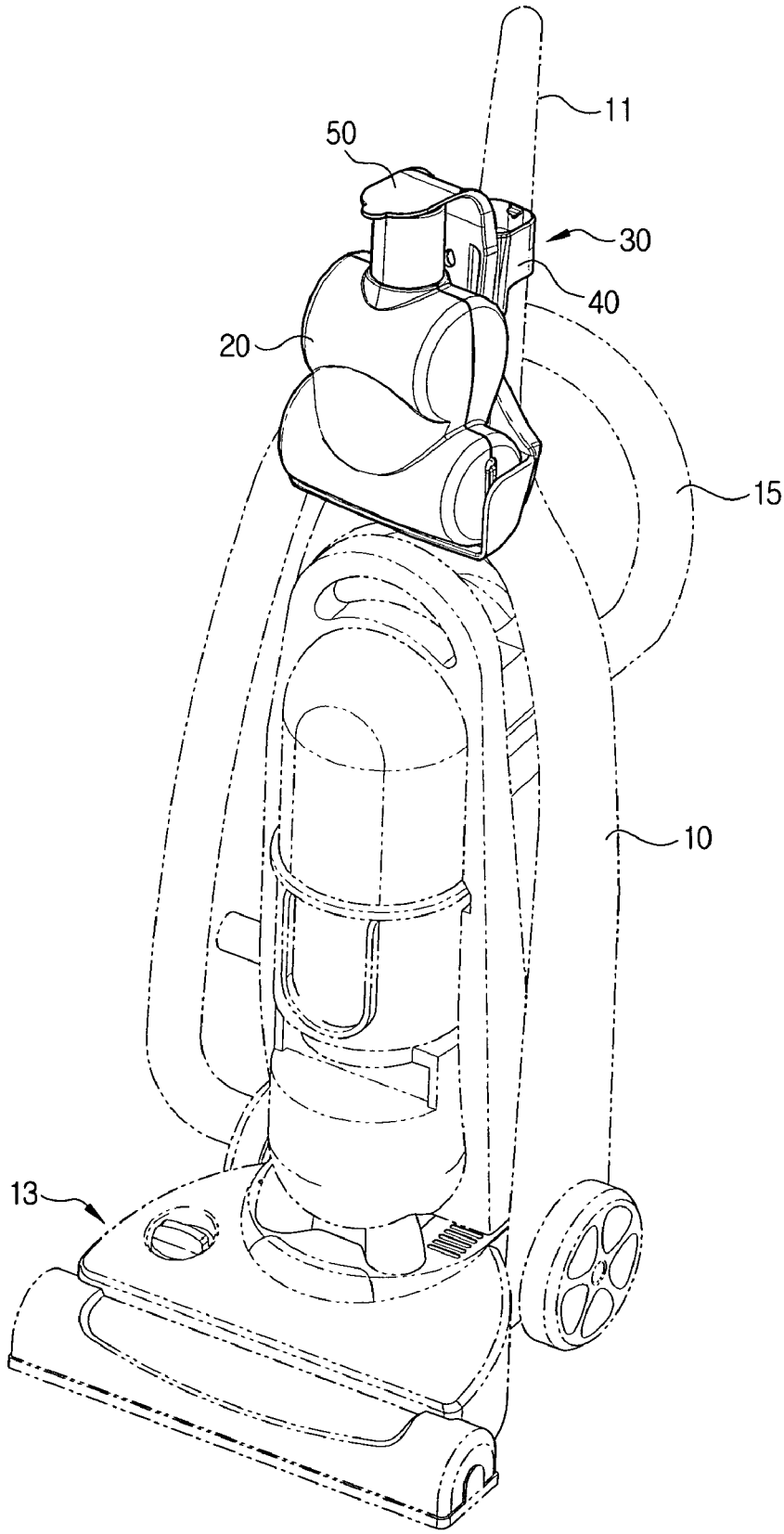
FIG. 1 is a perspective view of an upright type vacuum cleaner shown in phantom and of an accessory unit for mounting thereon according to an embodiment of the present invention.

Certain embodiments of the present invention will be described in greater detail with reference to the accompanying drawings.

In the following description, identical drawing reference numerals are used to identify the same or similar elements even between the different drawing figures. Elements described in the description, such as a detailed construction and function, are only provided to assist in a comprehensive understanding of the invention, and should not be considered as limiting. The present invention can be carried out without using some or all of those defined elements. Well-known functions or constructions are not described in detail to avoid obscuring the invention in unnecessary detail.

FIG. 1 shows an accessory unit mounted in an upright type vacuum cleaner, shown in phantom, according to an embodiment of the present invention.

Figure 4:
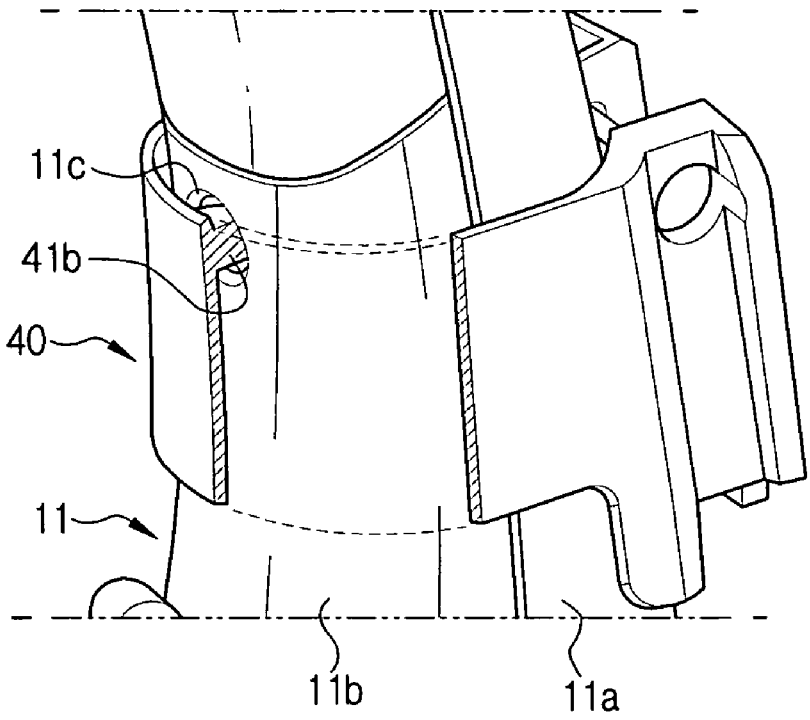
FIG. 4 is a partial perspective view showing the hanger of FIG. 3 attached to the handle of the upright type vacuum cleaner.

Referring to FIG. 1, an upright type vacuum cleaner, shown in phantom, according to this embodiment comprises a cleaner body 10 to which a handle 11 is attached on an upper portion thereof, a suction brush 13 movably engaged to the lower part of the cleaner body 10, and a connecting hose 15 connecting the cleaner body 10 to the suction brush 13 and providing fluid communication therebetween. A motor driving chamber and a dust-collecting chamber are defined within the cleaner body 10 also in a fluid communication therebetween. The connecting hose 15 is connected to the dust-collecting chamber and the suction brush 13 at respective ends thereof. One end of the connecting hose 15 can be detached from the suction brush 13. More specifically, the handle 11 has convergent sides and thus becomes gradually narrower in a direction away from the connecting portion where it connects to the cleaner body 10. As shown in FIG. 4, the handle 11 comprises a front cover 11*a* and a rear cover 11*b*, which are fastened by appropriate fastening members, such as screws. The rear cover 11*b* includes a fastening hole 11*c* for the engagement with a fastening member 41*b* of a hanger 40, according to the present invention.

The accessory unit preferably comprises a turbine brush 20, which is selectively engageable to one end of the connecting hose 15, and an accessory support device 30, which supports accessories, such as turbine brush 20, to the accessory handle 11. The accessory support device 30 comprises a hanger 40 attached to the accessory handle 11, and a support bracket 50, removably attached to the hanger 40.

Figure 2:
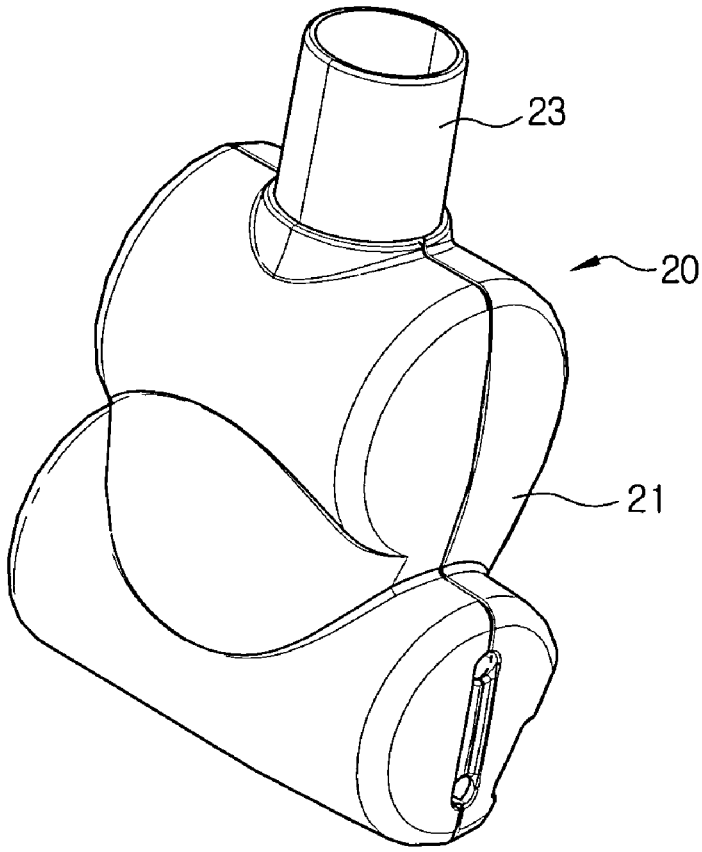
FIG. 2 is a perspective view of the accessory unit shown in FIG. 1.

As shown in FIG. 2, the turbine brush 20 has a similar construction as those of generally-known brushes. That is, the turbine brush 20 has a brush body 21, having a suction port defined at a lower portion, and a connecting tube 23 connected with the brush body 21, at an upper portion thereof. The connecting tube 23 may be connected to one end of the connecting hose 15. A turbine rotated by the suction air being drawn through the vacuum cleaner, and an agitator rotated in association with the turbine, may be provided inside the brush body 21. The turbine brush 20 and its detailed construction is neither a feature nor adds significantly to the scope of the present invention.

Figure 3:
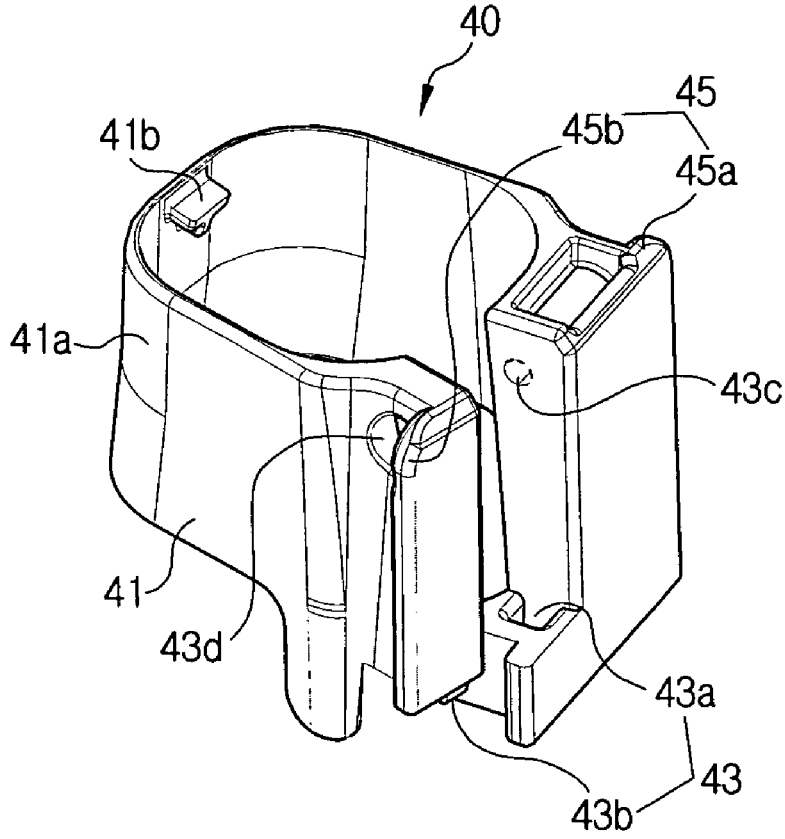
FIG. 3 is a perspective view of a hanger for mounting the accessory unit shown in FIG. 1.

As shown in the detailed view of FIG. 3, the hanger 40 comprises a band body 41, substantially in the configuration of an incomplete circle which wraps substantially around the handle 11, a mating part 43 provided at terminating ends of the band body 41, and a first fastening part 45.

The band body 41 has a hollow hole at a center defining an aperture configured to receive the handle 11, and a resilient part 41*a*. The mating part 43 includes two mating parts complimentarily formed on both terminating ends of the semicircular band body 41. The mating part 43 includes a positioning hole 43*a* formed at an end of the band body 41, a positioning protrusion 43*b* formed on the other end of the band body 41, and fastening holes 43*c*, 43*d* correspondingly formed on both ends of the band body 41. The positioning hole 43*a* is disposed to extend in a direction transverse to the plane defined by the circumferential encompassing direction of the band body 41 around the handle 11. Therefore, the positioning hole 43*a* preferably extends in a direction substantially perpendicular to the wrapping direction of the band body 41. The positioning protrusion 43*b* is configured and oriented to provide for insertion into the positioning hole 43*a* in substantially vertical direction. The positioning hole 43*a* and the positioning protrusion 43*b* are provided at either of the ends of the band body 41. The fastening holes 43*c* and 43*d* are aligned with each other when the positioning protrusion 43*b* is inserted into the positioning hole 43*a*, so as to allow for fastening engagement therewith.

The first fastening part 45 is formed to correspond to a second fastening part 55 of the support bracket 50, which will be described below with reference to FIG. 5. The first fastening part 45 comprises a pair of fastening ribs 45*a* and 45*b* provided at either end of the band body 41. The fastening ribs 45*a* and 45*b* are integrally formed with the band body 41, and are arranged side by side and extend in a substantially vertical direction.

A protruding lock 41*b* is formed on an inner diameter surface of the hanger 40, which is intended for contacting the handle 11 of the cleaner body 10 when assembled. The protruding lock 41*b*, as shown in FIG. 4, is inserted into the fastening hole 11*c* of the handle 11 when the hanger 40 is attached to the handle 11. When the protruding lock 41*b* is inserted into the fastening hole 11*c*, the hanger 40 is locked from rotating in a circumferential direction relative to the handle 11 or from slipping upwardly or downwardly in an axial direction relative to the handle 11.

Figure 5:
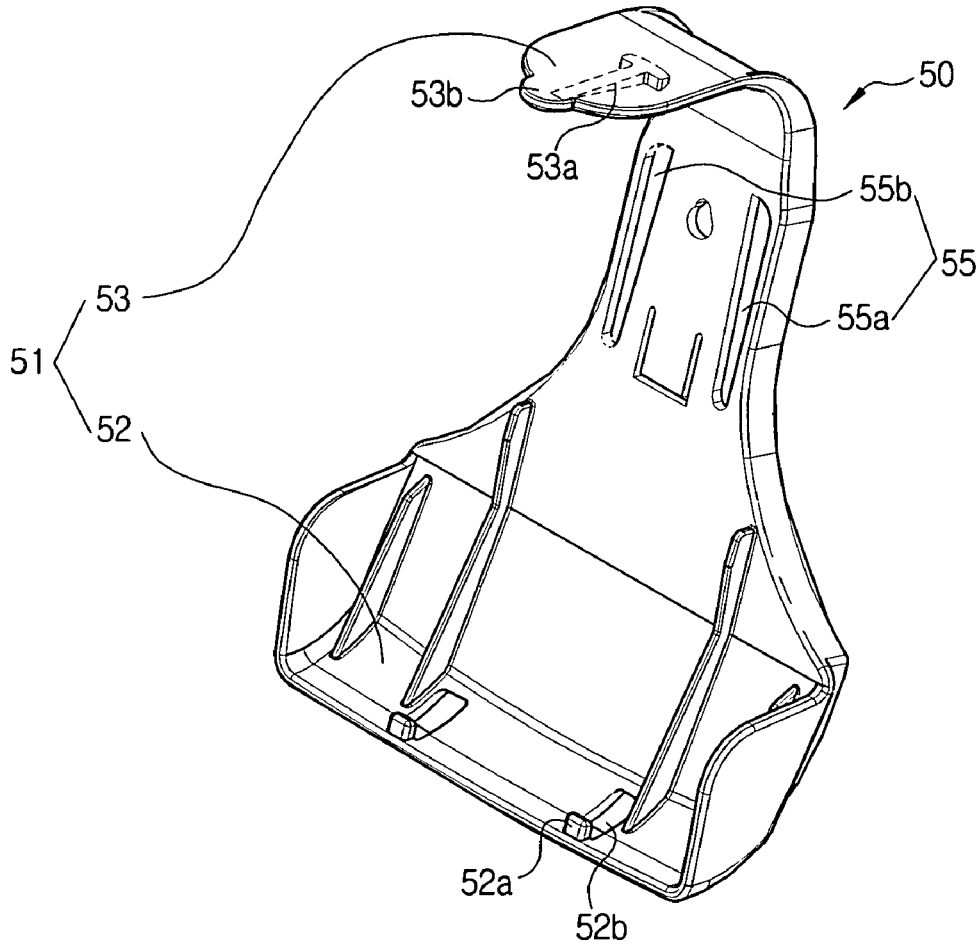
FIG. 5 is a detail perspective view of a support bracket shown in FIG. 1.

Referring now to FIG. 5, the support bracket 50 comprises a mounting part 51 for supporting the turbine brush 20, and the second fastening part 55, for fastening with the first fastening part 45 of the hanger 40.

The mounting part 51 comprises a main support 52 and a resilient support 53, which are configured to face each other in opposing relationship across a space roughly the size of the turbine brush 20. The brush body 21 of the turbine brush 20 (FIG. 2) is mounted and supported on the main support 52. The resilient support 53 covers and supports an end of the connecting tube 23 of the turbine brush 20.

Figure 9:
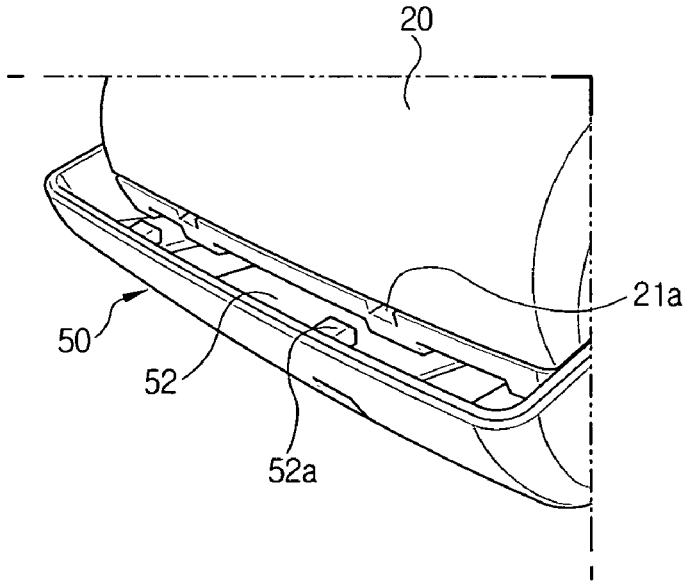
FIG. 9 is a partial perspective view illustrating the support bracket and the turbine brush engaged with ach other.

A position fixing part is provided adjacent the mounting part 51 so as to restrict movement of the turbine brush 20. The position fixing part comprises a position fixing protrusion 52*a* and a position fixing hole 52*b* provided to the main support 52, and a locking protrusion 53*a* provided to the resilient support 53. A plurality of position fixing protrusions 52*a* and the positioning fixing holes 52*b* are formed at appropriate locations to enable the cradling of the turbine brush 20. A hole 21*a* is formed in the brush body 21 of the turbine brush 20 to correspond to the protrusion 52*a* (FIG. 9). The position fixing protrusion corresponding to the position fixing hole 52*b* may be formed on the brush body 21.

The resilient support 53 has a handle tab 53*b* protruding outwardly from an end thereof. The resilient support 53 is deformed when engaged to an end of the connecting tube 23. More specifically, the handle tab 53*b* is inserted in the connecting tube 23 and is locked therein. Once mounted in the mounting part 51, the turbine brush 20 is not easily separated therefrom. When the user presses upwardly on the handle tab 53*b*, it lifts up the resilient support 53, as the resilient support 53 deforms to permit releasing the turbine brush 20 from the locked state.

The second fastening part 55 is provided adjacent the back of the surface on which the mounting part 51 of the support bracket 50 is formed. The second fastening part 55 has a pair of slits 55*a* and 55*b* that correspond to the first fastening part 45, i.e., to the fastening ribs 45*a* and 45*b*, of the hanger 40. The slits 55*a* and 55*b* are formed side by side to have a predetermined length, and are arranged at a predetermined interval from each other to correspond to the fastening ribs 45*a* and 45*b*.

Figure 6:
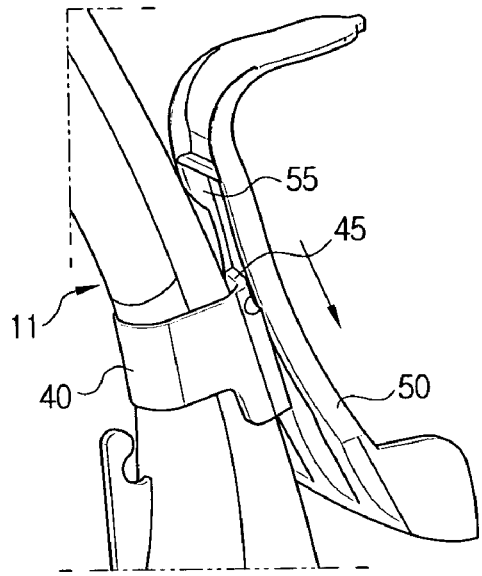
FIGS. 6 and 7 illustrate in partial side perspective views, respectively, of the operation of the support bracket as it is fastened to the hanger.
Figure 7:
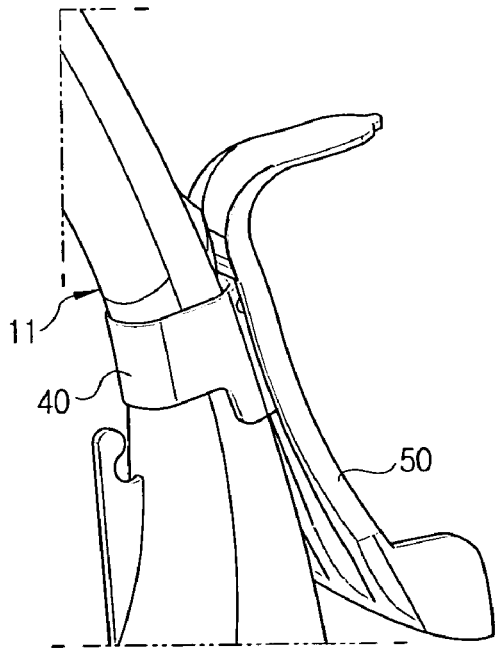
Figure 8:
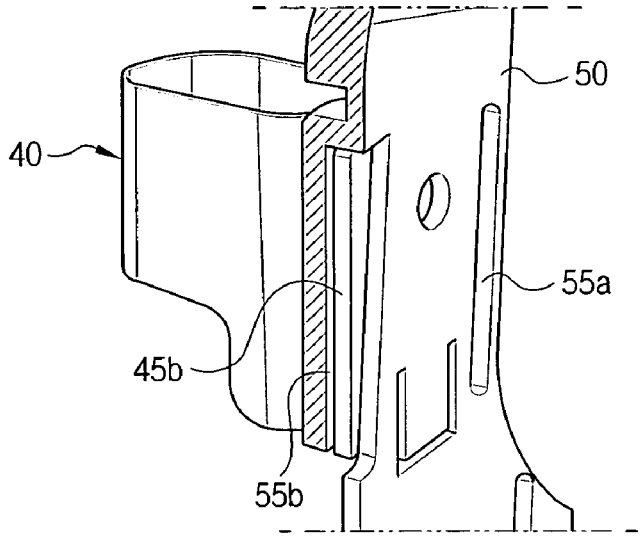
FIG. 8 is a partially cross-sectional perspective view showing the hanger and the support bracket fastened to each other.

Referring now to FIG. 6, with the second fastening part 55 of the support bracket 50 facing the first fastening part 45, the support bracket 50 is positioned to slide in the direction indicated by the arrow. Then, as shown in FIG. 7, the support bracket 50 can slide downwardly, and the respective fastening parts 45 and 55 complimentarily mate and engage with each other, as shown in the partial cross-section view of FIG. 8. As the fastening ribs 45*a* and 45*b* are fit into the slits 55*a* and 55*b*, the connection of both ends of the band body 41 to the mounting part 50 is reinforced.

As described above, the accessory unit according to the present invention can be selectively employed for use in the upright type vacuum cleaner having a handle 11. The handle 11 is formed by connecting the front and rear covers 11*a* and 11*b* (FIG. 4) by a general screw fastening method. Accordingly, for the connection of the covers 11*a* and 11*b*, insertion holes such as fastening hole 11*c* is defined so that the hanger 40 can be fastened firmly to the handle 11.

According to the present invention, attaching and detaching the support bracket 50 and the hanger 40 are simple. The hanger 40 is first fastened to the handle 11, the support bracket 50 is attached to the hanger 40, and then the assembly of the accessory support device is completed. Thus, accessories, such as turbine brush 20, may be mounted on the support bracket 50 in accordance with this invention.

As described above in a few exemplary embodiments of the present invention, an accessory support for an upright type vacuum cleaner and an accessory unit are stowed in the vacuum cleaner, and therefore, the unnecessary inconvenience of having to keep the accessory support and accessory unit in other places is eliminated, and it becomes convenient to keep and carry around the accessory support and accessory unit together with the vacuum cleaner.

Additionally, the possibility of misplacement or loss of the accessories decreases, and the convenience of using the accessories increases.

Furthermore, the accessory unit according to the present invention is compatible with various types of vacuum cleaners and can be used therewith.

The foregoing embodiment and advantages are merely exemplary and are not to be construed as limiting the present invention. The description above can be readily applied to other types of apparatus. Also, the description of the embodiments of the present invention is intended to be illustrative, and not to limit the scope of the claims, and many alternatives, modifications, and variations will become apparent to those skilled in the art upon achieving an understanding of the invention.

What is claimed is:

1. A vacuum cleaner comprising:

a cleaner body;

a suction brush disposed on a lower part of the cleaner body;

a handle connected to the cleaner body and a connecting part located between the handle and the cleaner body;

an accessory support for the vacuum cleaner comprising:

a hanger attached to the connecting part between the handle and the cleaner body; and a support bracket detachably attached to the hanger, and having a mounting part on which an accessory may be removably mounted;

wherein, said hangar is comprised of:

a band body having a hollow opening for receiving the connecting part of the vacuum cleaner therein, the band body taking on the configuration of substantially an incomplete circle terminating two terminating ends;

mating parts formed on both terminating ends of the band body for complementary engagement to each other; and first fastening parts provided adjacent both terminating ends of the band body, for engagement with the mating parts and then with the support bracket.

2. The accessory support of claim 1, wherein the first fastening parts comprise fastening ribs formed at both terminating ends of the band body.

3. The accessory support of claim 1, wherein the connecting part has a hole formed therein, and the band body has a protrusion for insertion into the hole of the connecting part, formed on an inner surface for contacting the connecting part.

4. The accessory support of claim 1, wherein each mating part further comprises:

a positioning hole formed adjacent a first terminating end of the band body;

a positioning protrusion for insertion in the positioning hole, provided at a second terminating end of the band body; and fastening holes provided to the first and second terminating ends of the band body, the fastening holes being aligned with each other when the positioning protrusion is engaged in the positioning hole.

5. The accessory support of claim 4, wherein the positioning protrusion and the positioning hole are engaged with each other such that when the band body wraps around the connecting part, the connecting part extends in a direction substantially transverse relative to the plane defined by the band body.

6. The accessory support of claim 1, wherein the band body comprises a resilient part capable of temporary deformation by an external force and recoverable to an original state when released from the external force, thereby enabling the mating parts to removably engage with each other.

7. The accessory support of claim 1, wherein the support bracket further comprises:

a body including the mounting part; and a second fastening part provided to the back of the surface on which the mounting part is provided, being detachably attached to the hanger.

8. The accessory support of claim 7, wherein the mounting part further comprises:

a main support provided at a lower portion of the body to encompass a first end of the accessory; and a resilient support provided at an upper portion of the body, facing in an opposing relation to the main support, to resiliently support a second end of the accessory.

9. The accessory support of claim 8, wherein the main support and the resilient support each comprises a position fixing part to restrict movement of the accessory.

10. The accessory support of claim 8, wherein the resilient support comprises a handle tab for resilient deformation of the resilient support.

11. The accessory support of claim 7, wherein the second fastening part comprises a slit formed in the back of the surface on which the mounting part of the body is provided, along which the hanger may be slidably engaged.

12. The accessory support of claim 1, wherein the accessory may comprise a turbine brush which is connected with a first end of a connecting hose, as desired, the connecting hose being connected at the first end to the suction brush and connected at a second end to the cleaner body.

13. An upright type vacuum cleaner, comprising:

a turbine brush selectively connected to a first end of a connecting hose, the connecting hose for connecting a suction brush formed at a lower part of the cleaner body to the cleaner body;

a hanger detachably attached to the cleaner body; and a support bracket detachably attached to the hanger, and having a mounting part on which the turbine brush may be removably mounted; and wherein the turbine brush further comprises a brush body having a suction port therein and a connecting tube to connect the brush body and the connecting hose, and the support bracket further comprises a main support for encompassing and supporting the brush body, and a resilient support for resiliently retaining the brush body and locking in an end of the connecting tube.

14. The accessory unit of claim 13, wherein the main support and the brush body respectively comprise a position fixing hole and a position fixing protrusion for complimentary engagement with each other.

15. The accessory unit of claim 13, wherein the hanger and the support bracket each comprise a fastening rib and a corresponding slit, for providing a mechanism to slidably fasten the hanger to the support bracket along the direction determined by the weight of the turbine brush.

* * * * *